US005301445A

United States Patent [19]

Hoffmeister

[11] Patent Number: 5,301,445

[45] Date of Patent: Apr. 12, 1994

[54] ALBUM PAGE FOR BI-DIRECTIONAL INSERTION AND CENTERING OF RECTANGULAR IMAGES

[75] Inventor: Thomas Hoffmeister, Sunapee, N.H.

[73] Assignee: The Holson Burnes Company, North Smithfield, R.I.

[21] Appl. No.: 731,503

[22] Filed: Jul. 17, 1991

[51] Int. Cl.[5] ..... G09F 1/10

[52] U.S. Cl. ..... 40/537; 40/159

[58] Field of Search ..... 40/537, 159, 405, 124.2, 40/530

[56] References Cited

U.S. PATENT DOCUMENTS

| | | | |
|---|---|---|---|
| 3,596,393 | 8/1971 | Lithgow | 40/159 |
| 3,735,516 | 5/1973 | Wenstrom . | |
| 3,831,301 | 8/1974 | Reynard . | |
| 3,869,820 | 3/1975 | Holson . | |
| 4,447,973 | 5/1984 | Wihlke | 40/405 X |
| 4,462,854 | 7/1984 | Wenstrom et al. . | |
| 4,676,374 | 6/1987 | Wilkins . | |
| 4,860,468 | 8/1989 | Cliborn . | |
| 4,928,828 | 5/1990 | Cohen . | |
| 4,944,968 | 7/1990 | Wagner . | |
| 4,958,450 | 9/1990 | Roberg . | |
| 4,965,948 | 10/1990 | Ruebens | 40/537 |
| 5,000,319 | 3/1991 | Mermelstein . | |

*Primary Examiner*—Kenneth J. Dorner
*Assistant Examiner*—J. Bonifanti
*Attorney, Agent, or Firm*—St. Onge Steward Johnston & Reens

[57] ABSTRACT

An album page for insertion and centering of rectangular images is disclosed.

A storage and display page includes a backing sheet for supporting the image, and at least one pocket comprising a transparent sheet located in face-to-face relation with respect to the backing sheet. The pocket is defined by attachment between the backing sheet and the transparent sheet along the bottom of the pocket and along two opposing side edges of the pocket and along two opposing side edges of the pocket. Two brackets extend upwardly from the bottom edge, and retain the images in a fixed and centered position.

20 Claims, 2 Drawing Sheets

ALBUM PAGE FOR BI-DIRECTIONAL INSERTION AND CENTERING OF RECTANGULAR IMAGES

BACKGROUND OF THE INVENTION

1. Field of the Invention

The present invention relates to an album page for insertion of rectangular images such as photographs. More specifically, the present invention relates to an album that permits widthwise or lengthwise insertion of the photograph, and preferably centering of the photograph.

2. Brief Description of the Prior Art

Several examples of a photo album page are disclosed in the prior art. Typically, a conventional album page comprises a backing sheet for supporting the photograph, and a transparent sheet overlaid in face-to-face relation with the backing sheet to provide a transparent cover for the photographs.

Most photographic and other images are rectangular in shape, wherein the height is greater than the width. While there are several prior art storage pages that permit lengthwise and widthwise insertion of a rectangular image, the prior art pages do not permit the photograph to be stored in a centered position within the pocket formed between the transparent sheet and the backing sheet. Thus, the images inserted into a conventional storage page may not be vertically aligned with one another. Vertical alignment and centering is useful to provide a neat and organized appearance.

In addition, in several prior art storage pages, when a rectangular image is inserted, the image may not be retained in a fixed position relative to the backing sheet. Thus, during turning of several pages of the storage album, the rectangular image may slide downwardly or move laterally within the space provided.

Examples of various prior art storage pages are disclosed in the following U.S. Pat. Nos. 3,735,516, 3,831,301, 3,869,820, 4,462,854, 4,676,374, 4,860,468, 4,928,828, 4,944,968, 4,958,450, 4,965,948, and 5,000,319.

SUMMARY OF THE INVENTION

A page for storage and display of a rectangular image is provided whereby a rectangular image can be centered within its pocket irrespective of whether it is inserted widthwise or lengthwise. This is obtained as described in accordance with one aspect of the invention, by bracketing the rectangular image so that it cannot move laterally or vertically downward once it is inserted into the pocket.

In accordance with the invention, the storage and display page is particularly suited for a rectangular image having a first dimension and a second dimension that is small than the first dimension. These rectangular images are typically photographs, such as 3"×5" or 4"×6" photos, but may comprise any type of image, such as a collector's card, a computer printout, or such other rectangular images desired to be stored and displayed.

The page includes a backing sheet for supporting the image and having a width and height substantially greater than the first dimension of the image.

At least one pocket for an image is provided on a page and comprises a transparent sheet located in face-to-face relation with respect to the backing sheet. The pocket is defined by attachment between the backing sheet and the transparent sheet along the bottom of the pocket and along two opposing side edges of the pocket. The attachment typically comprises an adhesive and, in a preferred embodiment of the invention, a heat-activated adhesive. The pocket has an opening along the top edge to provide for insertion and removal of the rectangular image.

The two opposing pocket side edges are spaced-apart a distance slightly greater than the larger dimension of the image. The top and bottom edges of the pocket are spaced-apart a distance also slightly greater than the larger dimension of the image. Within the general confines of the pocket, the transparent sheet is attached to the backing sheet along a pair of spaced-apart centering areas, which can be local dots but preferably elongate brackets which extend up from the attached bottom edge.

The centering areas are spaced-apart a distance slightly greater than the second and smaller dimension of the rectangular image to permit lengthwise insertion of the image between the centering areas, which prevent lateral movement within the pocket. Thus, the image is essentially bracketed by the centering areas and the attached bottom edge of the pocket.

The distance between the centering areas is less than the first and larger dimension of the image so that a widthwise insertion of the image causes it to seat above the centering areas. Thus, when an image is inserted widthwise, the image is bracketed by the two opposing side edges to be generally centrally located in the pocket.

In accordance with one aspect of the invention, the storage page contains two pockets, one pocket is mounted vertically above the other pocket with the side edges of the top pocket in vertical alignment with the side edges of the bottom pocket. The opening along the top edge of the pocket permits a rectangular image to be inserted from above. The image is centered within the top pocket whether it is inserted widthwise or lengthwise. The same is true of the image inserted in the bottom pocket. When both images are inserted, they are centered within their respective pockets, and since the two pockets are in vertical alignment, the images are also in symmetrical alignment.

Once images are inserted in the two pockets, the images are retained in a fixed position with respect to the backing sheet, and are retained against lateral sliding movement and vertical downward movement. Since gravity normally prevents upward movement of the image, it is retained in a fixed, centered position.

Other advantages of a storage page in accordance with the present invention will be apparent from the following detailed description of the invention.

DETAILED DESCRIPTION OF THE INVENTION

Figure 1:
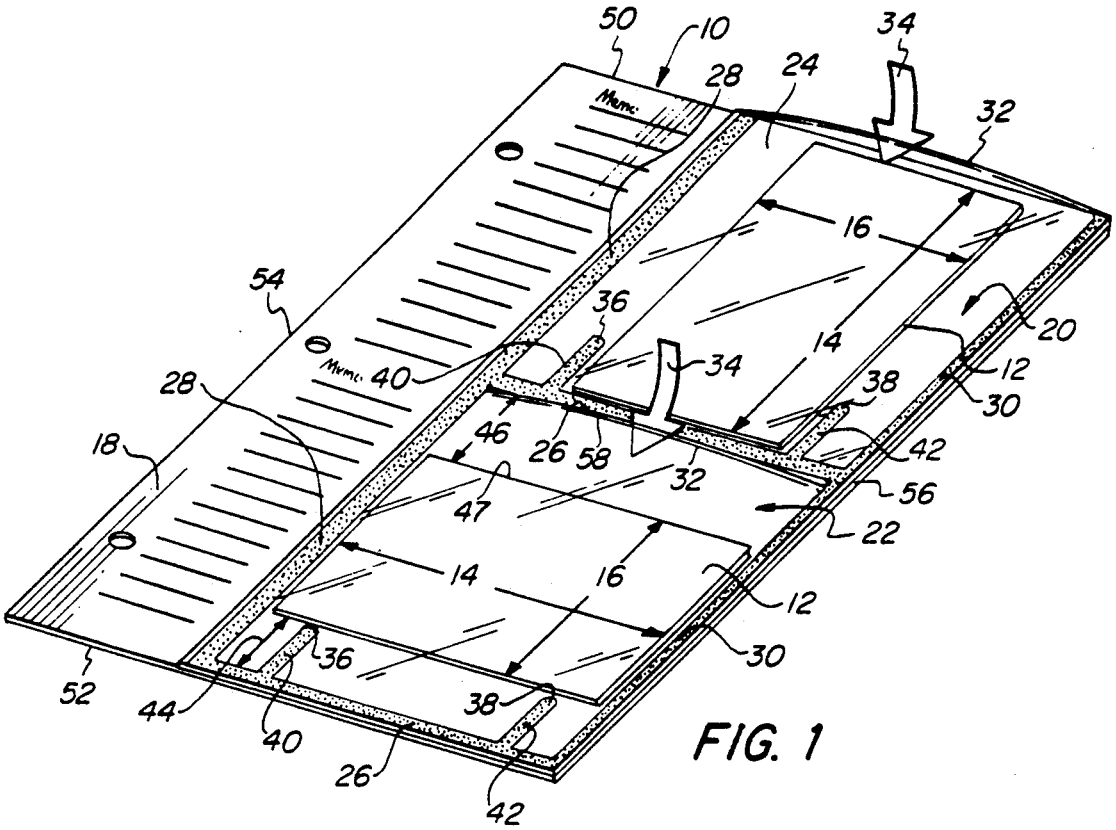
FIG. 1 is a perspective view of a page in accordance with the present invention.
Figure 2:
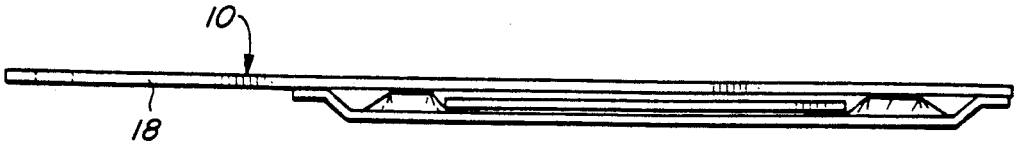
FIG. 2 is a top, on-edge view of the page shown in FIG. 1.

Referring to the figures, a page 10 for the storage and display of a rectangular image, such as a photograph and the like, is shown. The rectangular image may be a photograph, a collector's card or any other rectangular image, that is desired to be stored and displayed. As shown in FIG. 1, the rectangular image 12 has a first dimension 14 corresponding to its height and a second dimension 16 corresponding to its width. The second dimension is smaller than the first dimension.

A backing sheet 18 is provided and has a width and height substantially greater than the first dimension 14 of the rectangular image 12. The backing sheet may be made of various materials suitable for supporting a photograph including heavy paper, cardboard, and where appropriate, plastic materials. In a preferred embodiment of the invention, the backing sheet 18 is made from suitable paper stock.

In accordance with one aspect of the invention, at least one pocket is provided for storing the rectangular image. In the case of the storage page shown in the drawings, the page includes a top pocket 20 and a bottom pocket 22. Each pocket is defined by attachment of the backing sheet 18 and a transparent sheet 24 along a bottom edge 26 of the pocket and along two opposing side edges 28 and 30 of each pocket. The pocket is open along the top edge 32 to permit insertion and removal of the rectangular image 12 as shown by arrows 34 in FIG. 1.

In a preferred embodiment of the invention, the transparent sheet comprises a clear, polymer sheet as are well known for use in photo albums and can be attached to the backing sheet by an adhesive, such as well-known heat-activated adhesives.

The transparent sheet 24 is further attached to the backing sheet 18 at least two separate upper areas 36 and 38 that are located within the pockets 20, 22. The areas 36 and 38 can be isolated dots but preferably the upper end portions of a pair of elongate brackets 40 and 42. The brackets 40 and 42 extend inwardly from the attached bottom edge 26 of each pocket 20, 22 for a predetermined distance from the attached bottom edge 26 in order to center a rectangular image inserted widthwise in the pocket. This is illustrated with the bottom pocket 22, which has the lengths 44 of the brackets 40, 42 so chosen as to be equal to the distance 46 between the top edge 47 of a widthwise inserted image 12 and the top edge 32 of pocket 22.

Other placements of the rectangular image 42 can be obtained by adjusting the lengths 44 of brackets 40, 42.

Figure 3:
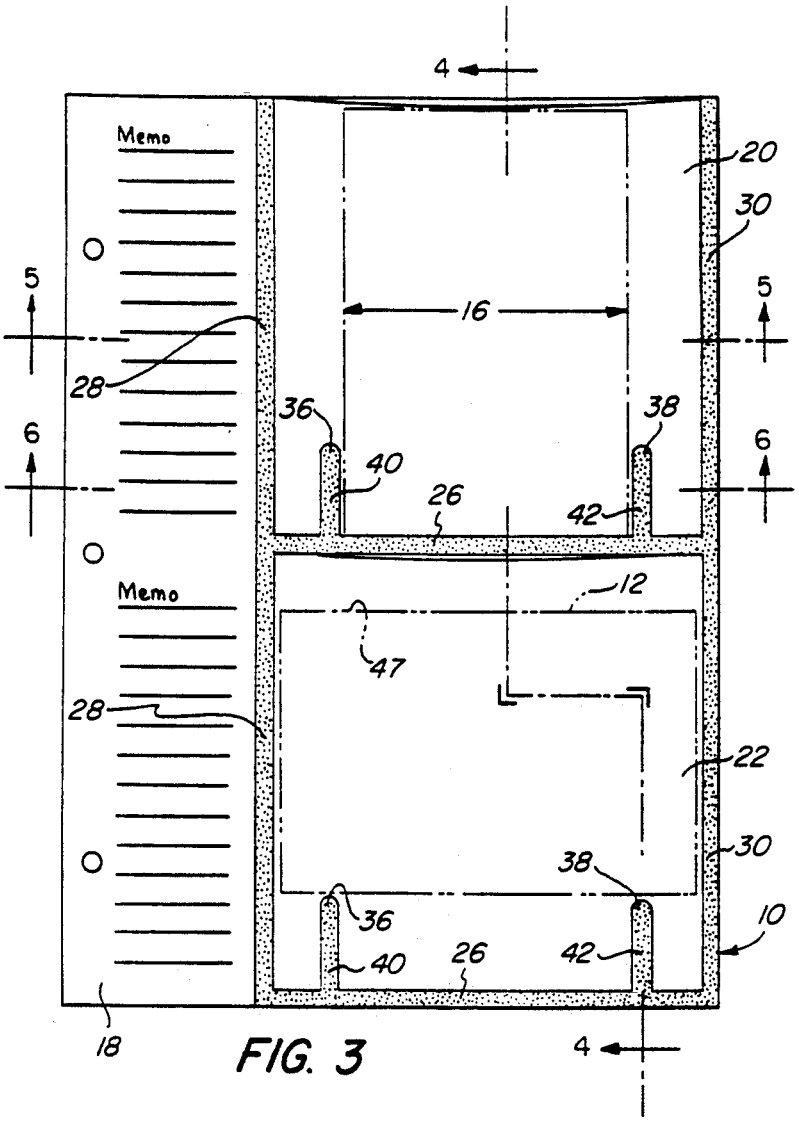
FIG. 3 is plan view of the page shown in FIG. 1.

As shown with reference to pocket 20 in FIG. 3, the brackets 40, 42 are spaced-apart by a distance that is just slightly larger than the smaller dimension 16 of the rectangular image. Thus, when the rectangular image is inserted in a lengthwise direction, the image extends between the two centering areas 36 and 38 and is held against lateral movement and is centered within pocket 20 by making the distances between the brackets 40, 42 and adjacent sides 28, 30 approximately the same.

In accordance with another aspect of the invention, the rectangular image 12 is retained in a fixed position whether it is inserted lengthwise or widthwise. For example, when a rectangular image is inserted lengthwise as shown in FIG. 3, the image is centered by brackets 40 and 42 and supported by bottom edge 26. Gravity retains the rectangular image against vertical upward movement.

When a rectangular image is inserted widthwise, the rectangular image is bracketed to prevent lateral movement by opposing attached side edges 28 and 30. The upper areas 36 and 38 of brackets 40 and 42 support the widthwise insertion of the image and gravity retains the image against vertical upward movement.

Hence, once the images are stored in a pocket 20 or 22, they do not move. In order to remove the pictures, one simply reaches into the pocket and withdraws the picture vertically upwardly.

In accordance with a preferred embodiment of the invention, each pocket is approximately square, and the distance between the top and bottom edges is approximately equal to the distance between the two side edges. In the case where there are multiple pockets on a given page, such as the case with the page shown in the figures, the pockets may be formed by attaching a single transparent sheet to the backing page 18. During manufacture, adhesive is applied to the backing sheet at a location which corresponds to the two opposing edges 28 and 30 and the bottom edges 26. In addition, adhesive is applied to form brackets 40 and 42. A single transparent sheet is overlaid onto the backing sheet 18.

Figure 4:
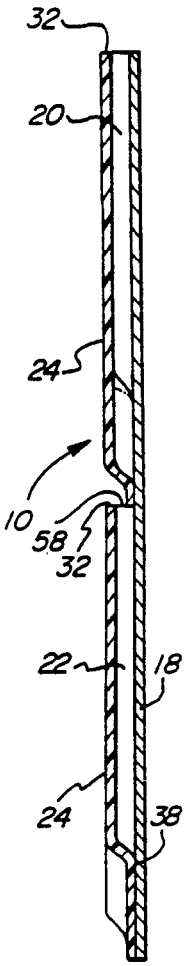
FIG. 4 is a sectional view taken along with the line 4—4 of FIG. 3.
Figure 5:
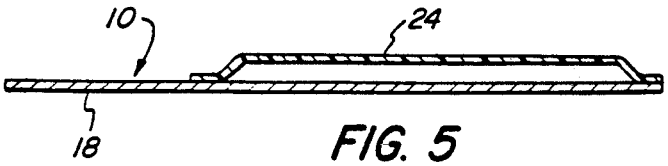
FIG. 5 is a sectional view taken along the line 5—5 of FIG. 3.
Figure 6:
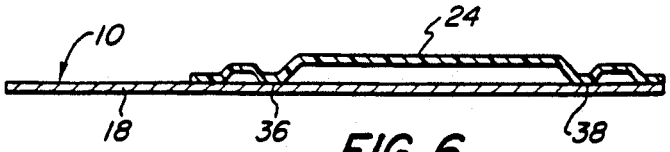
FIG. 6 is a sectional view taken along the line 6—6 of FIG. 3.

The backing sheet 18 has a generally rectangular shape having a top edge 50, and bottom edge 52, and two side edges 54 and 56. The top edge 32 of upper pocket 20 is aligned with the top edge 50 of the backing sheet. The bottom 26 of the lower pocket 22 is aligned with the bottom 52 of the backing sheet. The side edges 30 of both the top pocket 20 and the bottom pocket 22 are aligned with the side edge 56 of the backing sheet. When the single transparent sheet is attached to the backing sheet, the bottom edge 26 of the top pocket 20 would normally obstruct insertion of a photograph or other image into the bottom pocket 22. As a step during manufacturing, an elongate cut in the transparent sheet immediately beneath the bottom edge 26 of the upper pocket 20 is made. This cut 58 is shown in FIG. 4 and permits insertion of a photograph as indicated by arrow 34 in FIG. 1.

In accordance with one aspect of the invention, a memo or margin area is provided immediately adjacent the pockets. Thus, the transparent sheet would have a width substantially less than the width of the backing sheet 18 to leave the "memo" area as shown in the figures. Because the rectangular images are fixed in position, when writing is placed in the memo area, it can correspond directly to the adjacent picture, which is retained in a fixed position by bracketing as discussed above.

What is claimed is:

1. A page for storage and display of a rectangular image having a first dimension and second dimension smaller than said first dimension and four sides, said page comprising:

a backing sheet having a width and height substantially greater than the first dimension of said image;

at least one pocket for said image comprising a transparent sheet located in face-to-face relation with said backing sheet and having a width and height at least as great as the first dimension of said image, said pocket being defined by attachment between said backing sheet and said transparent sheet along a bottom edge of said pocket and along two opposing side edges of said pocket, said pocket having an opening along the top edge thereof to provide for insertion and removal of said rectangular image;

said transparent sheet being attached to said backing sheet at two separate areas located within said pocket, said areas being spaced-apart a distance slightly greater than said second dimension of said image to permit lengthwise insertion of the image between the areas and bracketing of said image on two sides thereof by said two areas and on one side thereof by said bottom edge of said pocket, said bracketing retaining said image against movement in three directions;

said two opposing pocket side edges being spaced-apart a distance slightly greater than said first dimension of said image, and, said distance of said areas being less than said first dimension of said image to obstruct widthwise insertion of said image beyond the areas, said two opposing pocket side edges bracketing said image on two sides thereof and said areas bracketing said image on one side thereby retaining said image against movement in three directions.

2. A storage page according to claim 1 wherein said areas are located to approximately center a lengthwise inserted image between said opposing side edges.

3. A storage page according to claim 2 wherein said areas are located to approximately center a widthwise inserted image between said top and bottom edges.

4. A storage page according to claim 3 wherein said spacing distance between said attached side edges retains a widthwise inserted image against lateral sliding movement.

5. A storage page according to claim 4 wherein said distance between said top and bottom edges is approximately equal to the distance between said two side edges.

6. A storage page according to claim 5 wherein said transparent sheet is attached to said backing sheet at a pair of spaced part brackets which extend inwardly from said attached bottom edge, said brackets including said spaced-apart areas at the ends thereof, said brackets extending inwardly from said bottom attached edge a predetermined distance in order to center a widthwise inserted image.

7. A storage page according to claim 6 wherein said transparent sheet is attached at the bottom and two side edges to said backing sheet by adhesive.

8. A storage page according to claim 7 wherein said brackets are formed by attachment of said transparent sheet to said backing sheet with an adhesive.

9. A storage page according to claim 3 and further including at least two of said pockets for displaying said rectangular images, one said pocket located vertically beneath the other of said pockets, the side edges of said one pocket being in vertical alignment with the side edges of said other pocket, said rectangular images inserted in one said pocket being vertically centered with respect to the image in said other pocket irrespective of the direction of insertion of both said images.

10. A storage page according to claim 9 wherein said page contains two pockets and wherein said backing sheet has a generally rectangular shape having top and bottom edges and opposing side edges, the top edge of upper pocket being in alignment with the top edge of the backing sheet, the bottom edge of the lower pocket being in alignment with the bottom edge of the backing sheet, one of said two side edges of each pocket being in alignment with a side edge of the backing sheet, the two pockets having a width substantially less than said width of the backing sheet to leave a marginal portion of the backing sheet uncovered.

11. A storage page according to claim 10 wherein said marginal portion includes means for binding a plurality of such storage pages into an album.

12. A storage page according to claim 11 wherein said marginal portion includes a writing area for insertion of information relative to the adjacent images.

13. A storage page according to claim 12 wherein said writing area is centered with respect to said pocket and an image inserted in said pocket.

14. A storage page according to claim 9 wherein both said pockets are formed from a single transparent sheet and wherein said opening along the top edge of the lower pocket comprises an elongate cut in said transparent sheet immediately beneath the bottom edge of the upper pocket.

15. A storage page according to claim 1 wherein said pocket is defined by attachment between said backing sheet and said transparent sheet along said top, said bottom and said two opposing edges of said pocket, and wherein said opening along the top edge for insertion and removal of the image comprises an elongate cut in said transparent sheet.

16. A page for storage and display of a rectangular image having a first dimension and a second dimension smaller than the first dimension and four sides, said page comprising:

a backing sheet having a width substantially greater than the first dimension and a height at least as large as twice said first dimension;

a pair of pockets for rectangular images, said pockets formed by a single transparent sheet located in face-to-face relation with said backing sheet, one said pocket located vertically beneath the other of said pocket, each pocket being defined by attachment between said backing sheet and said transparent sheet along a bottom edge of said pocket and along two opposing said edges of said pocket, each said top pocket has an opening along the top edge thereof to provide for insertion and removal of said rectangular image, said bottom pocket having an opening along the top edge thereof formed by a cut in said transparent sheet immediately beneath the bottom edge of said top pocket, for each said pocket the two opposing edges being spaced-apart a distance slightly greater than said first dimension of said image to retain said image against lateral movement upon widthwise insertion of said image, the opposing edges of the top pocket being in vertical alignment with the opposing edges of the bottom pocket, and for each said pocket, a pair of spaced-apart brackets extending inwardly and upwardly from said attached bottom edge, said brackets being spaced-apart a distance slightly greater than said second dimension of said image to permit lengthwise insertion of the image between the brackets and to retain said image against lateral movement upon lengthwise insertion of said image, said distance of said brackets being less than the first dimension of said image to obstruct widthwise insertion of said image beyond the end of the bracket to provide for bracketing of said image on three sides thereof in each said pocket whether said image is inserted lengthwise or widthwise.

17. A storage page according to claim 16 wherein said brackets are located to approximately center a lengthwise inserted image between said opposing side edges.

18. A storage page according to claim 17 wherein said brackets are located to approximately center a widthwise inserted image between said top and bottom edges.

19. A storage page according claim 18 wherein said backing sheet has a generally rectangular shape having top and bottom edges and opposing side edges, the top edge of the upper pocket being in alignment with the top edge of the backing sheet, the bottom edge of the lower pocket being in alignment with the bottom edge of the backing sheet, one of said two side edges of each pocket being in alignment with the side edge of the backing sheet, the two pockets having a width substantially less than said width of the backing sheet to leave a marginal portion of the backing sheet uncovered.

20. A storage page according to claim 19 wherein said marginal portion includes a writing area for insertion of information relative to the adjacent image and wherein said writing area is centered with respect to its adjacent pocket and an image inserted in the pocket.

* * * * *